US005304761A

United States Patent [19]

Rosen et al.

[11] Patent Number: 5,304,761

[45] Date of Patent: Apr. 19, 1994

[54] ARC-PROOF MOLDED CASE CIRCUIT BREAKER

[75] Inventors: Louis A. Rosen, Hartford; Timothy W. Webber, Bristol; Louis M. Frutuoso, Newington, all of Conn.

[73] Assignee: General Electric Company, New York, N.Y.

[21] Appl. No.: 836,573

[22] Filed: Feb. 18, 1992

[51] Int. Cl.[5] ..... H01H 9/30; H01H 33/00

[52] U.S. Cl. ..... 200/144 R; 200/304; 335/202

[58] Field of Search ..... 200/144 R-151, 200/304-306; 361/345-363; 335/201, 202

[56] References Cited

U.S. PATENT DOCUMENTS

| | | | |
|---|---|---|---|
| 3,198,915 | 8/1965 | Wortmann | 200/144 R |
| 3,295,078 | 12/1966 | Hrynewycz | 335/124 |
| 3,451,019 | 6/1969 | Auer et al. | 335/201 |
| 3,578,928 | 5/1971 | Schuessler et al. | 200/144 R |
| 4,181,836 | 1/1980 | Miracle | 200/144 R |
| 4,744,003 | 5/1988 | Koslosky et al. | 361/363 |
| 4,754,247 | 6/1988 | Raymont et al. | 335/202 |
| 4,928,080 | 5/1990 | Jacobs et al. | 335/202 |
| 4,957,447 | 9/1990 | Hibbert et al. | 439/207 |
| 4,965,544 | 10/1990 | Kelaita, Jr. et al. | 335/202 |
| 4,970,482 | 11/1990 | Jacobs et al. | 335/201 |
| 5,067,043 | 11/1991 | Markowski et al. | 361/361 |

*Primary Examiner*—J. R. Scott

*Attorney, Agent, or Firm*—Richard A. Menelly

[57] ABSTRACT

An industrial rate multi-phase molded case circuit breaker is fitted with an exhaust gas barrier and line lug cover at the line end thereof to redirect the arc exhaust gases exiting from the line end. An electric circuit is prevented between the different phases of a multi-phase electric power distribution system connected with the line end of the circuit breaker. Furthermore, an electric circuit is further prevented between the exiting arc exhaust gases and the electrical distribution bus bars to which the multi-phase electric circuit breaker is connected.

17 Claims, 3 Drawing Sheets

ARC-PROOF MOLDED CASE CIRCUIT BREAKER

BACKGROUND OF THE INVENTION

Electric power distribution panelboards, switchboards and busway are currently available which accept circuit breakers and electric switches by means of a plug-on connection to the bus bars arranged therein. U.S. Pat. No. 4,744,003 describes one such panelboard arrangement. When electric switches or circuit breakers are to be installed on-site within such an operating panelboard, switchboard or busway system the electric power must be temporarily discontinued and the panelboard or switchboard disassembled before such electric switch or circuit breaker can be installed. Where modifications must be made to the panelboard or switchboard interior in order to accept the electric switch or circuit breaker, some time is required before the power can be turned ON. This disruption in electric power within an industrial environment could cause scheduling problems both with respect to the related equipment as well as to operating personnel.

With same panelboard, switchboard and busway enclosures, it is often convenient to directly plug the electric switch or circuit breaker directly onto the edge-mounted electric bus bars with minor modification in which case the panelboard or switchboard must be de-energized to prevent damage to the equipment as well as to personnel. To deter electrical circuit with the bus bars in the event that the enclosure becomes inadvertently energized, some means should be employed to prevent direct access at all times to those bus bars that are not connected with the modular enclosures, electric switches or circuit breakers.

U.S. Pat. No. 4,754,247, entitled "Molded Case Circuit Breaker Accessory Enclosure", describes a circuit breaker having an electronic trip unit and accessory devices mounted within the circuit breaker cover and accessed by means of an accessory cover without affecting the integrity of the circuit breaker case which contains the circuit breaker operating components such as the operating mechanism, contacts and arc chute. A wire access slot formed within the circuit breaker case allows for the egress of the wire conductors leading to the accessories while an arc vent slot formed within the circuit breaker case adjacent the arc chute provides supplemental gas venting to the arc gases that are generated during circuit interruption. When such side-vented circuit breakers are used within the panelboards, switchboards and busway systems containing the edge-mounted bus bars, the bus bars should be shielded from direct contact with the arc gas by-products that accompany the arc gas evolution from the vent slot.

U.S. Pat. No. 5,067,043 describes a plurality of insulation seals positioned over the exposed bus bars within panelboards and switchboards containing the edge-wise mounted bus bars to shield the bus bars from the gaseous by-products issuing from the circuit breakers during intense circuit interruption. Similarly, the bus bars and tab connections of the busway are insulated to shield the bus bars from the gaseous by-products.

The so-called "current limiting" circuit interruption accomplished within the circuit breakers described within the aforementioned U.S. Pat. No. 4,754,247 interrupts the circuit current in the early stages of the current waveform in order to limit the let through current to a reasonable value. However, such rapid circuit interruption results in an intense arc discharge that must be rapidly cooled and quenched within the circuit breaker arc chute in a relatively short period of time.

It would be economically advantageous to provide a so-called "arc proof" circuit breaker whereby the hot gases generated during the circuit interruption process are prevented from exiting in the direction of the electrical distribution power connections at the line end of the circuit breakers.

Accordingly, one purpose of the invention is to describe an inexpensive, arc-proof circuit breaker usable within panelboards, switchboards and busway systems without requiring that the associated edge-mounted bus bars be separately shielded.

SUMMARY OF THE INVENTION

The invention comprises a two part arc exhaust gas cover arranged over the line terminal connections at the line end of the circuit breaker. The first part is in the form of an exhaust gas barrier positioned over the arc gas exhaust vents and the line terminal connections to decrease the intensity of the exiting arc exhaust gases. The second part is in the form of a line lug cover which collects and directs the arc gases along the sides of the circuit breaker enclosure away from the line end thereof.

DESCRIPTION OF THE PREFERRED EMBODIMENT

Figure 1:
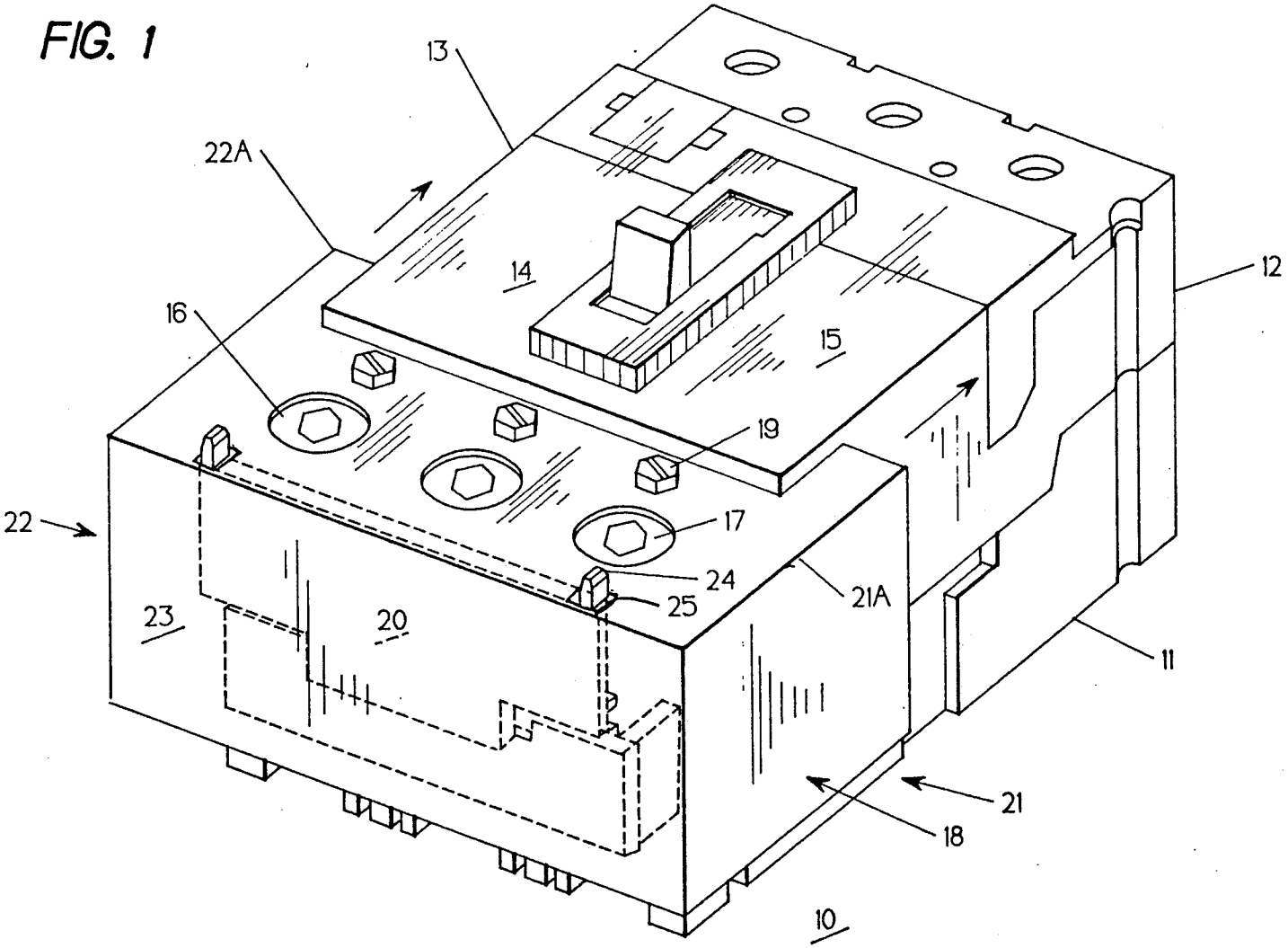
FIG. 1 is a top perspective view of an arc gas proof circuit breaker in accordance with the invention.

For purposes of this disclosure, an "arc-proof" circuit breaker is a circuit breaker in which the arc gases are directed away from the line terminal connections. One such arc-proof circuit breaker 10 is depicted in FIG. 1 and is of the type consisting of a molded plastic case 11 to which a molded plastic cover 12 is fixedly secured. An accessory cover 13 is attached to the circuit breaker cover and includes a pair of accessory doors 14, 15. An exhaust gas barrier 20 is positioned at the line end of the circuit breaker and a lug cover 18 is next positioned over the attached gas barrier 20. The line lug cover 18 contains a parallel endpiece 23 with a pair of opposing sides 21, 22, all integrally formed to a single unitary member. The exhaust gases emanating from the line end of the circuit breaker contact the exhaust gas barrier 20 and become cooled and de-ionized in the process. The arc gases then contact the interior surfaces of the line lug cover 18 and become directed out the open ends of the side arm extensions 21A, 22A formed on the opposing sides as indicated by the directional arrows. Access to the line terminal connections behind the exhaust gas barrier 20 is made through the line terminal access openings 16 in the top of the line lug cover 18 which are arranged over the line terminal access plugs 17. The lug cover 18 is secured to the circuit breaker cover 12 by means of screws 19, as indicated. The exhaust gas barrier 20 accurately positions the line lug cover 18 by means of upstanding tabs 24 which extend through rectangular slots 25 formed on the top surface of the line lug cover 18.

Figure 2:
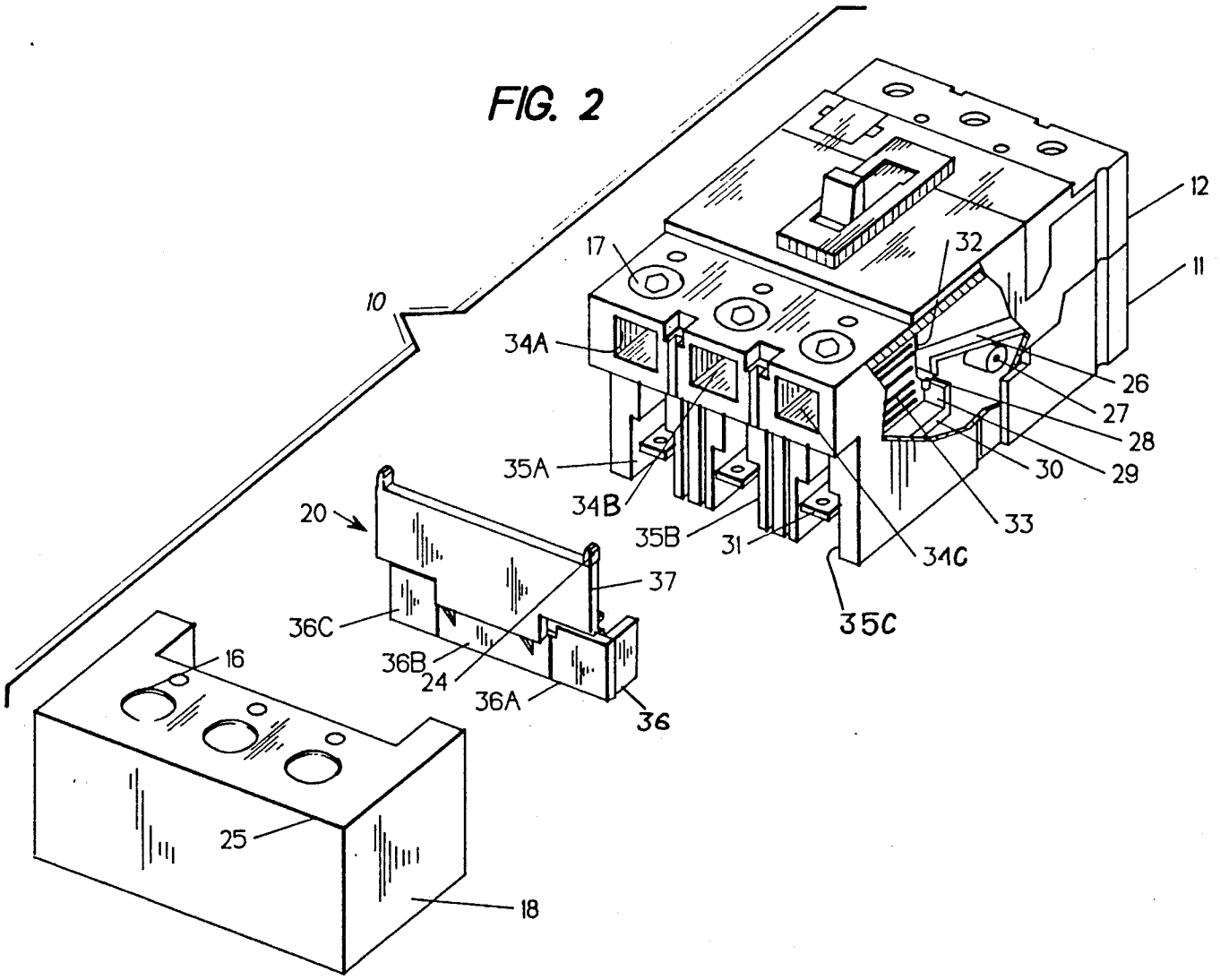
FIG. 2 is top perspective view of the arc-proof circuit breaker of FIG. 1 prior to attachment of the connector plate and line lug cover.

The operation of the arc-proof circuit breaker 10 is best seen by referring now to FIG. 2, wherein a portion of the circuit breaker case 11 and cover 12 are removed to depict the interior thereof. The circuit breaker 10 is a current limiting circuit breaker, as described earlier, and includes a movable contact arm 26 which supports an attached movable contact 28. The movable contact arm 26 is controlled by operation of the operating mechanism crossbar 27 to rapidly rotate the movable contact 28 away from the fixed contact 29 attached to the fixed contact support 30 upon the occurrence of an over-current condition. An arc chute 32, such as described in U.S. Pat. No. 4,970,482, surrounds and guides the arc that occurs upon separation of the fixed and movable contacts by transfer of the arc gases that are generated during intense circuit interruption through a plurality of arc plates 33 to rapidly cool and de-ionize the electrically charged arc gases. The arc gases exit from the circuit breaker cover 12 by means of the exhaust gas vents 34A–34C which exist at each pole of the three pole configuration depicted in FIG. 2. Electrical connection is made with the corresponding electrical distribution circuit by means of line straps 31 that are arranged within the corresponding line lug compartments 35A–35C, as indicated. To cool and de-ionize the exiting arc gases, the line terminal compartment connector plate 36 on the bottom part of the exhaust gas barrier 20 having individual line terminal compartment connector plates 36A, 36B, 36C, is positioned over the arc gas exhaust vents 34A–34C and the line lug compartments 35A–35C to prevent electrical access to the line straps 31 contained therein. At the same time, the exhaust gas deflector plate 37 on the top part of the exhaust gas barrier 20 is positioned in front of the arc gas exhaust vents 34A–34C and, because of the offset relation between exhaust gas deflector plate 37 and the line terminal compartment connector plate 36, a clearance space is defined between the arc gas exhaust vents 34A–34C and the exhaust gas deflector plate 37 to allow for the controlled egress of the exhaust arc gases. With the exhaust gas barrier 20 attached to the line side of the circuit breaker 10, the plastic or fiber electrically insulating line lug cover 18 is next positioned over the exhaust gas barrier 20 by capturing the tabs 24 extending from the top of the exhaust gas deflector plate 37 within corresponding rectangular slots 25 that are found in the top surface of the lug cover 18. The insertion of the tabs 24 within the slots 25 accurately positions the line terminal access openings 16 in the top surface of the lug cover 18 over the line terminal access plugs 17 to allow access to the line straps 31 for attaching and detaching from the corresponding electrical distribution bus bars (not shown).

Figure 3:
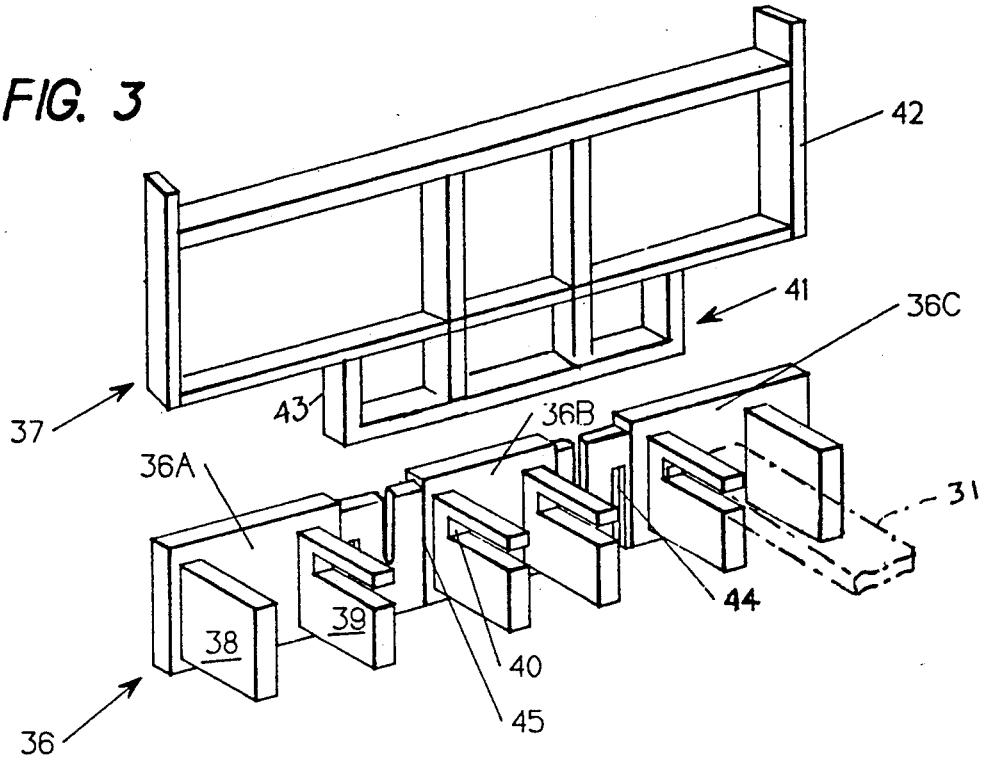
FIG. 3 is an enlarged front perspective view of the connector plate of FIG. 1.

The exhaust gas barrier 20 is depicted in FIG. 3 with the line terminal compartment connector plate 36 separated from the exhaust gas deflector to show the additional support provided by means of a yoke member 41. Upstanding ribs 43 on the yoke member provide the additional support, while the upstanding ribs 42 formed on the exhaust gas deflector plate 37, also provide support. To allow for a pressed-fit insertion within the line lug compartments 35A–35C of FIG. 2, a pair of arms 38, 39 extend from each of the individual line terminal compartment connector plates 36, as illustrated at 36A for example, and corresponding slots 40 receive the line straps 31 as indicated in phantom to provide additional attachment support to the exhaust gas barrier 20 as well as to provide additional insulation and arc gas deflection. The exhaust gas barrier 20 is formed from a flame retardant plastic such as NORYL which is a registered trademark of GE Company for a synthetic thermoplastic resin. To provide for the tolerance accumulation between the line terminal compartments, a pair of elongated opposing slots 44 are formed in the flexible tabs 45 between the individual line terminal compartment connector plates 36A, 36B, 36C. The flexibility provided by the elongated slots markedly compensates for the variations in the dimensions of the corresponding line terminal compartments 36A–36C to accommodate both field and factory installation of the exhaust gas barriers 20.

Figure 4:
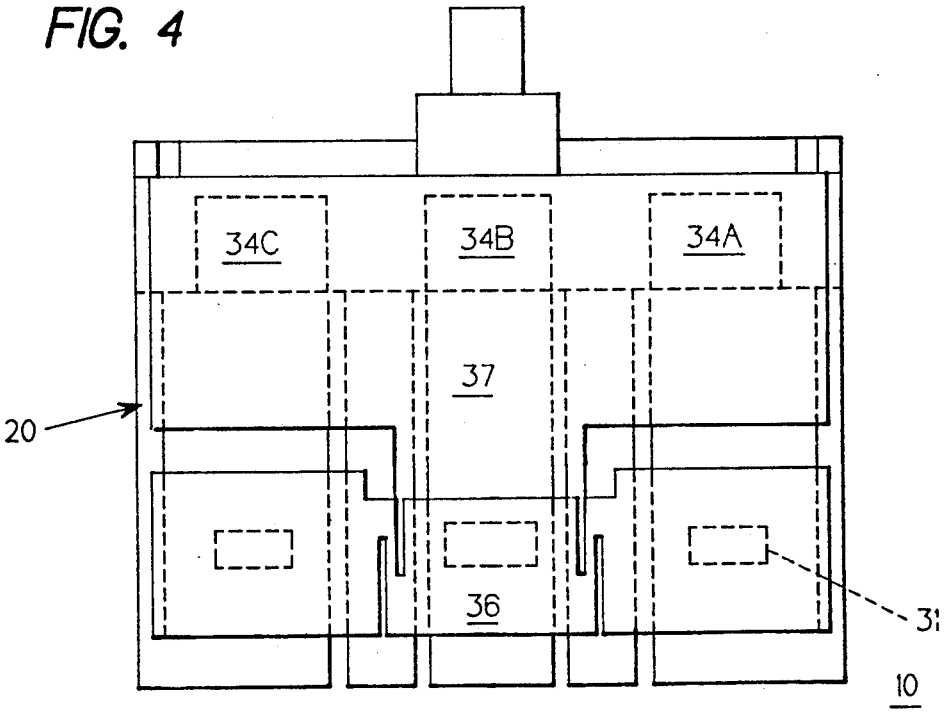
FIG. 4 is an end view of the arc-proof circuit breaker of FIG. 1 with the connector plate attached prior to the connection of the line lug cover.

The arc-proof circuit breaker 10 is depicted in FIG. 4 with the exhaust gas barrier 20 having the deflector plate 37 attached to the line terminal connector plate 36 positioned on the line end of the circuit breaker before attaching the line lug cover 18. It is seen that the exhaust gas deflector plate 37 provides line-of-site interference with the egress of the arc exhaust gases by blocking the respective arc gas exhaust vents 34A–34C while the line terminal compartment connector plate 36 effectively insulates the corresponding line straps 31.

The provision of the exhaust gas barrier 20, per se, as depicted in FIG. 4, is beneficial for diverting the exhaust arc gases from the line end of the circuit breaker 10 to prevent the occurrence of so-called "interphasal faults" and finds application in certain electric panelboard, switchboard and busway system designs. The addition of the lug cover 18, as depicted in FIG. 1, finds application within busway plug enclosures such as those described in U.S. Pat. No. 4,957,447. The exhaust arc gases are deflected by the line lug cover away from the line end of the breaker which is associated with the power line distribution bus bars and which line straps remain energized although the circuit breaker operating handle 8 is in its OFF position. The deflection of the exhaust arc gases away from the line end of the arc-proof circuit breaker 10 to the direction of the opposite or load end of the circuit breaker is important since the associated electrical power distribution bus bars connecting with the load end of the circuit breaker become electrically de-energized upon circuit interruption as well as when the circuit breaker operating handle is moved to its OFF position.

Having thus described our invention, what we now claim as new and desire to secure by Letters Patent is:

1. An arc deflector for molded case circuit breakers comprising:

a unitary plastic plate having top and bottom interconnected parts;

means extending from said top part arranged for attaching said top part to a circuit breaker arc shield; and means extending from said bottom part arranged for attaching said bottom part to a circuit breaker line lug compartment.

2. The arc deflector of claim 1 wherein said top part is coextensive with a plurality of circuit breaker exhaust vents and is arranged for deflecting arc gases exiting from said exhaust vents.

3. The arc deflector of claim 1 wherein said bottom part comprises a plurality of spaced individual plates offset from said top part, each of said individual plates including a pair of arms extending from said individual plates and arranged for being received within separate openings within a circuit breaker line lug compartment thereby preventing arc gases from one line lug compartment from mixing with arc gases form another line lug compartment.

4. The arc deflector of claim 3 wherein said individual plates are interconnected by means of flexible tabs extending in a first plane coplanar with said individual plates.

5. The arc deflector of claim 4 wherein said flexible tabs include a first pair of parallel elongated slots arranged in said first plane.

6. The arc deflector of claim 5 wherein said flexible tabs include a second pair of elongated slots arranged in a second plane perpendicular to said first plane.

7. The arc deflector of claim 1 wherein said arms are separated by a distance capable of fitting in circuit breaker line lug compartments in a press-fit relation to thereby attach said unitary plate to circuit breaker line lug compartments.

8. An exhaust shield for circuit breaker exhaust arc gases comprising:

an electrically-insulative enclosure open at a front and bottom part thereof and closed at a top, bottom and sides;

side attachment means extending from a front part of said sides arranged for overlapping an end part of a circuit breaker case and cover;

access means formed within said top and arranged for line-of-sight alignment with circuit breaker line lug connectors when said enclosure is attached to an end part of a circuit breaker case and cover; and top attachment means formed within said top and arranged for receiving tabs extending from a circuit breaker line lug arc exhaust gas deflector arranged for positioning over an end part of a circuit breaker case and cover on a line end of said circuit breaker.

9. The exhaust shield of claim 8 wherein said side attachment means comprise a pair of side extensions integrally-formed with said enclosure sides.

10. The exhaust shield of claim 8 wherein said access means comprise a plurality of circular apertures formed within said top.

11. The exhaust shield of claim 8 wherein said top attachment means comprise a plurality of rectangular slots.

12. An arc proof circuit breaker comprising in combination:

a plastic cover attached to a plastic case enclosing circuit breaker operating components;

line lug compartments arranged at one end of said case and including a plurality of line lugs arranged for connection with electric power distribution cables; and an exhaust arc gas deflector arranged partially within said line lug compartments, said deflector having top and bottom interconnected parts, top means extending from said top part arranged for attaching said top part to a circuit breaker arc shield, and bottom means extending from said bottom part arranged for attaching said bottom part to a circuit breaker line lug compartment.

13. The arc-proof circuit breaker of claim 12 wherein said top part is coextensive with arc gas exhaust vents on one end of said cover.

14. The arc-proof circuit breaker of claim 12 wherein said bottom part comprises a plurality of individual plates offset from said top part, each of said individual plates including a pair of arms extending from said individual plates and arranged for being received within separate line lug compartments thereby preventing arc gases form one line lug compartment from mixing with arc gases from another line lug compartment.

15. The arc-proof circuit breaker of claim 12 wherein said exhaust shield comprises an electrically-insulative enclosure open at a front and bottom part thereof and closed at a top, bottom and sides, side attachment means extending from a front part of said sides arranged for overlapping an end part of said circuit breaker case and cover, access means formed within said top and arranged for line-of-slight alignment with circuit breaker line lug connectors when said shield is attached to said circuit breaker case and cover, and top attachment means formed within said top and arranged for receiving tabs extending from said arc exhaust gas deflector.

16. The circuit breaker of claim 15 wherein said side attachment means comprise a pair of side extensions integrally-formed with said enclosure sides.

17. The circuit breaker of claim 15 wherein said access means comprise a plurality of circular apertures formed within said top of said shield.

* * * * *